US012049719B2

(12) United States Patent
Kabure et al.

(10) Patent No.: US 12,049,719 B2
(45) Date of Patent: Jul. 30, 2024

(54) WATER INTRUSION PROTECTION FOR TECHFRAME AND CONSOLE

(71) Applicant: Whirlpool Corporation, Benton Harbor, MI (US)

(72) Inventors: Siddhesh S. Kabure, Sangli (IN); Pranav Kshirsagar, Satara (IN); Paula Lobaccaro, St. Joseph, MI (US); Akash Paidalwar, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 294 days.

(21) Appl. No.: 17/227,858

(22) Filed: Apr. 12, 2021

(65) Prior Publication Data

US 2022/0325461 A1 Oct. 13, 2022

(51) Int. Cl.
*D06F 34/34* (2020.01)
*D06F 34/30* (2020.01)

(52) U.S. Cl.
CPC ..... *D06F 34/34* (2020.02); *D06F 34/30* (2020.02)

(58) Field of Classification Search
CPC ..... D06F 34/28; D06F 34/30; D06F 34/34
See application file for complete search history.

(56) References Cited

U.S. PATENT DOCUMENTS

| | | | |
|---|---|---|---|
| 7,265,309 | B2 | 9/2007 | Kim et al. |
| 7,399,939 | B2 | 7/2008 | Hettinger et al. |
| 9,961,790 | B2 | 5/2018 | Kim et al. |
| 9,988,755 | B2 | 6/2018 | De Pellegrin et al. |
| 2004/0221479 | A1 | 11/2004 | Lee et al. |
| 2006/0081015 | A1 | 4/2006 | Rizzetto et al. |
| 2013/0091904 | A1 | 4/2013 | Kim et al. |
| 2014/0238832 | A1* | 8/2014 | Kim ..... H01H 19/02 200/336 |
| 2019/0330788 | A1 | 10/2019 | Yun |

FOREIGN PATENT DOCUMENTS

| | | | |
|---|---|---|---|
| CN | 106012429 | A | 10/2016 |
| CN | 107475998 | A | 12/2017 |
| CN | 108797009 | A | 11/2018 |
| CN | 108797010 | A | 11/2018 |
| CN | 108797011 | A | 11/2018 |
| CN | 109281128 | A | 1/2019 |
| JP | 06182091 | A * | 7/1994 |
| KR | 2000-0002814 | A | 1/2000 |

(Continued)

OTHER PUBLICATIONS

Machine translation of CN-108797011-A, dated Nov. 2018. (Year: 2018).*

(Continued)

*Primary Examiner* — Joseph L. Perrin
*Assistant Examiner* — Kevin G Lee
(74) *Attorney, Agent, or Firm* — Harness, Dickey & Pierce, PLC

(57) ABSTRACT

A fabric treatment machine with a console. The console has a volcano to receive an activation member. The activation member couples with an activation control unit mounted on a tech frame. A liquid deflection member on the console is positioned below the console volcano. A drain on the tech frame diverts fluid away from the activation control unit.

14 Claims, 3 Drawing Sheets

(56) References Cited

FOREIGN PATENT DOCUMENTS

| | | | | | |
|---|---|---|---|---|---|
| KR | 2002-0003754 | A | | 1/2002 | |
| KR | 2003-0026132 | A | | 3/2003 | |
| KR | 2004-0069134 | A | | 8/2004 | |
| KR | 2008-0098886 | A | | 11/2008 | |
| KR | 101405287 | B1 | * | 6/2014 | ..... D06F 34/28 |

OTHER PUBLICATIONS

Machine translation of KR-2004069134-A, dated Aug. 2004. (Year: 2004).*

Machine translation of JP-06182091-A, dated Jul. 1994. (Year: 1994).*

* cited by examiner

WATER INTRUSION PROTECTION FOR TECHFRAME AND CONSOLE

FIELD

The present disclosure relates to fabric treatment machines, such as washers and dryers, that include removable knobs and, more particularly, to the prevention of fluid entering the tech frame.

BACKGROUND

In current designed fabric treatment machines, a tech frame is mounted to a console. The tech frame has a volcano feature that extends through the console. The volcano feature includes an activation member within it. A knob is connected with the activation member to enable operation of the fabric treatment machine. Ordinarily an O-ring is positioned between the activation member and volcano bore to prevent liquid or water from passing into the tech frame and coming in contact with the activation control unit (ACU). Consumers, when cleaning their fabric treatment machines, remove the knobs to clean around them. When this occurs, there is the possibility that fluid or water can enter into the tech frame volcano. Thus, the water or fluid may sit on the O-ring for a long time until it evaporates.

The activation member receives an impact load applied by the knob. This load is directly transferred to the activation member that is positioned in the volcano on the tech frame. The water entering the tech frame does not have an exit from the tech frame volcano. Thus, there is always the risk that eventually due to the constant impact load applied to the activation member that the water or fluid will seep through the O-ring and onto the ACU. This could have a devastating effect on the ACU. Thus, it would be possible that the ACU would malfunction and need to be replaced.

SUMMARY

It is an object of the present disclosure to alleviate the disadvantages of the prior art. The present disclosure drains away fluid from the tech frame volcano. The present disclosure eliminates the need for a O-ring to seal the activation member in the tech frame volcano. The present disclosure drains fluid or water out and away from the ACU. The present disclosure continuously drains water away from the tech frame and the ACU so that accumulation of water near the tech frame is nonexistent.

Accordingly to the present disclosure, a fabric treatment machine with a console water protection device comprises a fabric treatment machine including a console. The console includes a volcano to receive an activation member. The activation member is coupled with an activation control unit mounted on a tech frame. A liquid deflection member is positioned on the console adjacent the console volcano. A drain is positioned on the tech frame to divert fluid away from the activation control unit. The volcano includes a wall defining a bore to receive a knob that couples with the activation member. The fluid deflection member is continuous with the volcano wall and is positioned below the activation member. The fluid deflection member includes a wall portion that defines a channel to direct fluid to the drain. The wall includes an apex that defines a V shape in cross-section with rails at the end of legs of the V to direct the fluid. The drain includes a ledge that projects from the tech frame. The ledge includes an apex adjacent a mid-portion of fluid deflection member. The ledge directs the fluid in opposing directions to drain fluid away from the ACU.

In another embodiment of the present disclosure, a fabric treatment machine comprising a cabinet housing including treatment components. A door enables access into the components within the housing. A console is on the cabinet. The console includes a volcano to receive an activation member. The activation member is coupled with an activation control unit mounted on a tech frame. A liquid deflection member is positioned on the console adjacent the console volcano. A drain is positioned on the tech frame to divert fluid away from the activation control unit. The volcano includes a wall that defines a bore to receive a knob that couples with the activation member. The fluid deflection member is continuous with the volcano wall and is positioned below the activation member. The fluid deflection member includes a wall portion that defines a channel to direct fluid to the drain. The wall includes an apex that defines a V shape in cross-section with rails at the end of legs of the V to direct fluid. The drain includes a ledge that projects from the tech frame. The ledge includes an apex adjacent a mid-portion of the fluid deflection member. The ledge directs the fluid in opposing directions to drain fluid away from the ACU.

According to a third aspect of the disclosure, a console for a fabric treatment machine comprises a volcano to receive an activation member. The activation member is coupled with an activation control unit mounted on a tech frame. A liquid deflection member is positioned on the console adjacent the console volcano. A drain is positioned on the tech frame to divert fluid away from the activation control unit. The volcano includes a wall that defines a bore to receive a knob that couples with the activation member. The fluid deflection member is continuous with the volcano wall and is positioned below the activation member. The fluid deflection member includes a wall portion that defines a channel to direct fluid to the drain. The wall includes an apex that defines a V shape in cross-section with rails at the end of legs of the V to direct fluid. The drain includes a ledge that project from the tech frame. The ledge includes an apex adjacent a mid-portion of fluid deflection member. The ledge directs the fluid in opposing directions to drain fluid away from the ACU.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
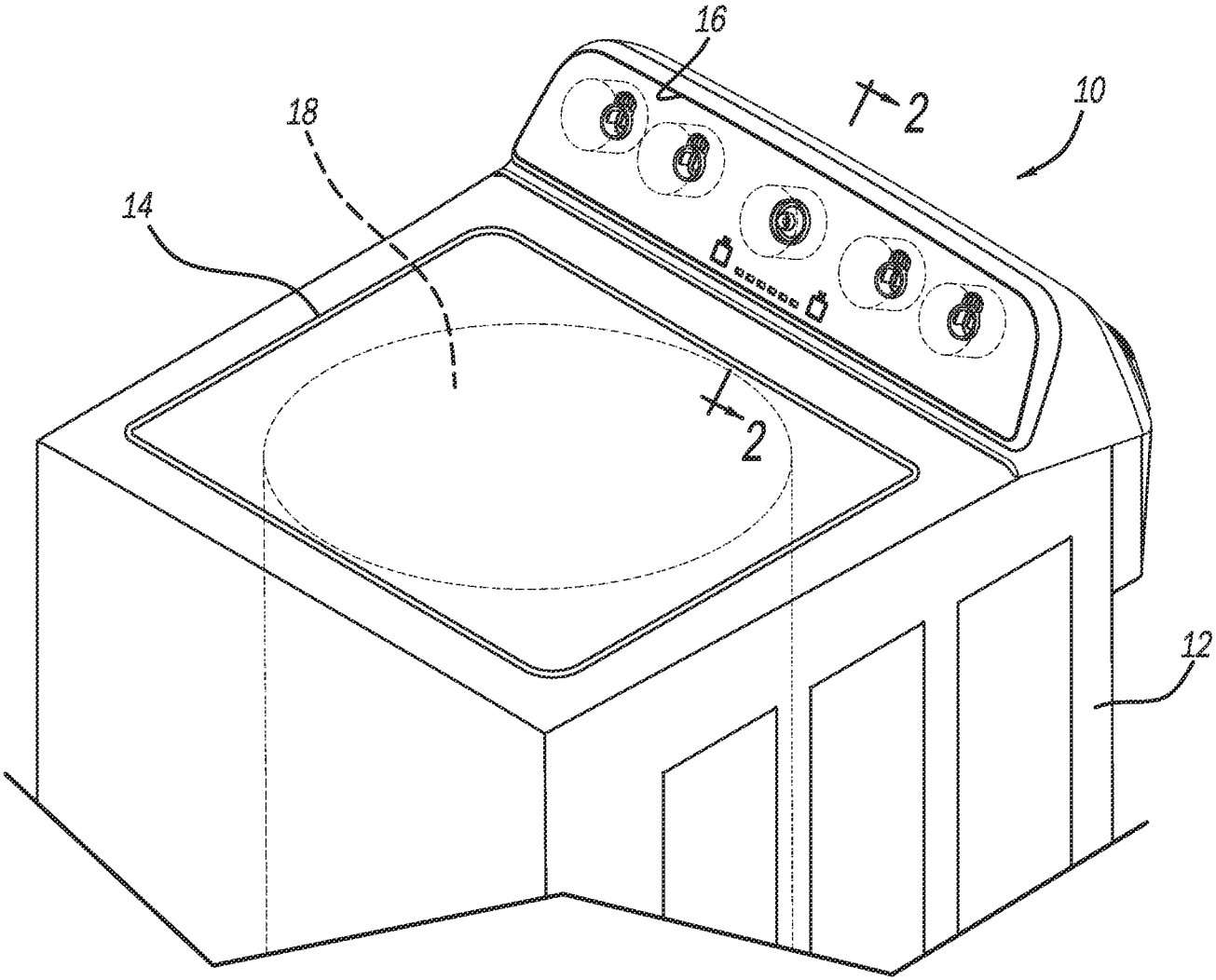
FIG. 1 is a perspective view of a fabric treatment machine in accordance with the disclosure.
Figure 2:
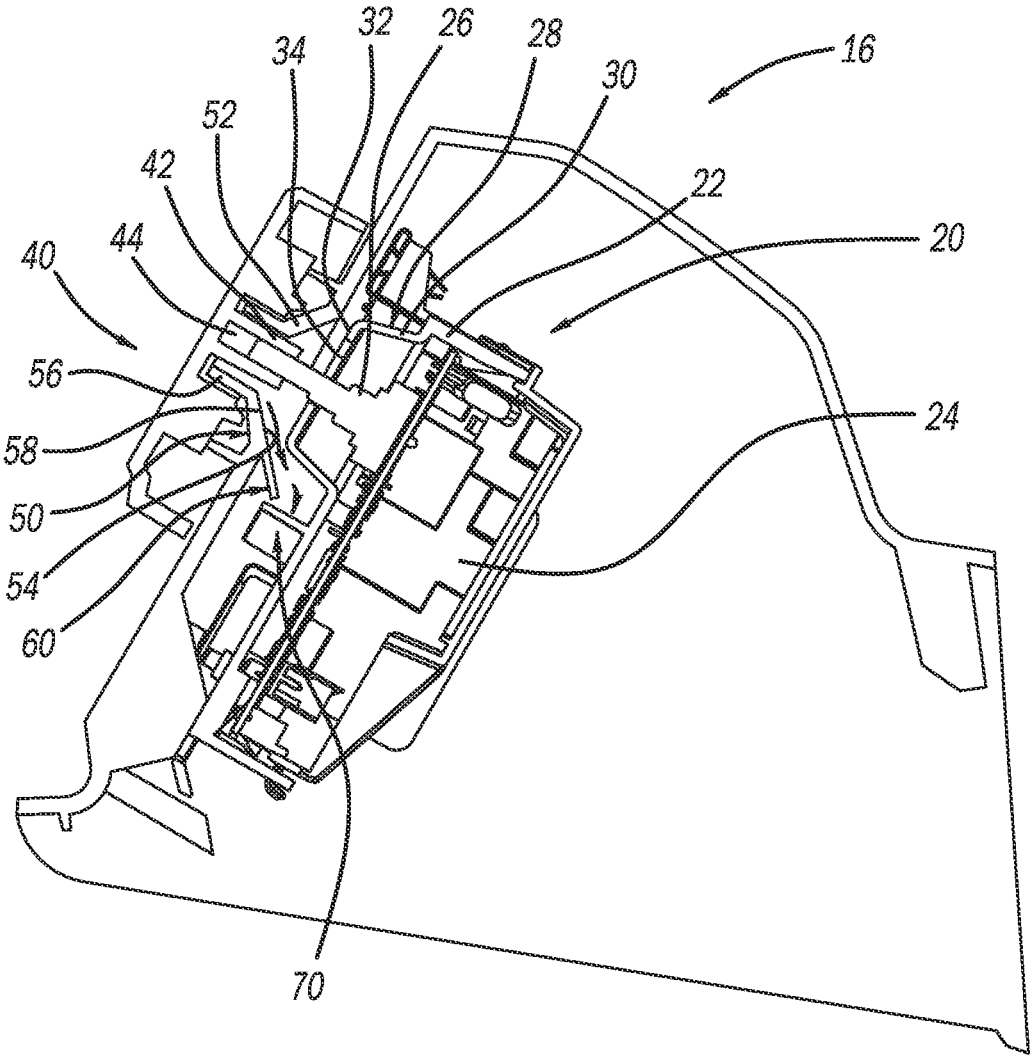
FIG. 2 is a cross-section view along line 2-2 of FIG. 1.
Figure 3:
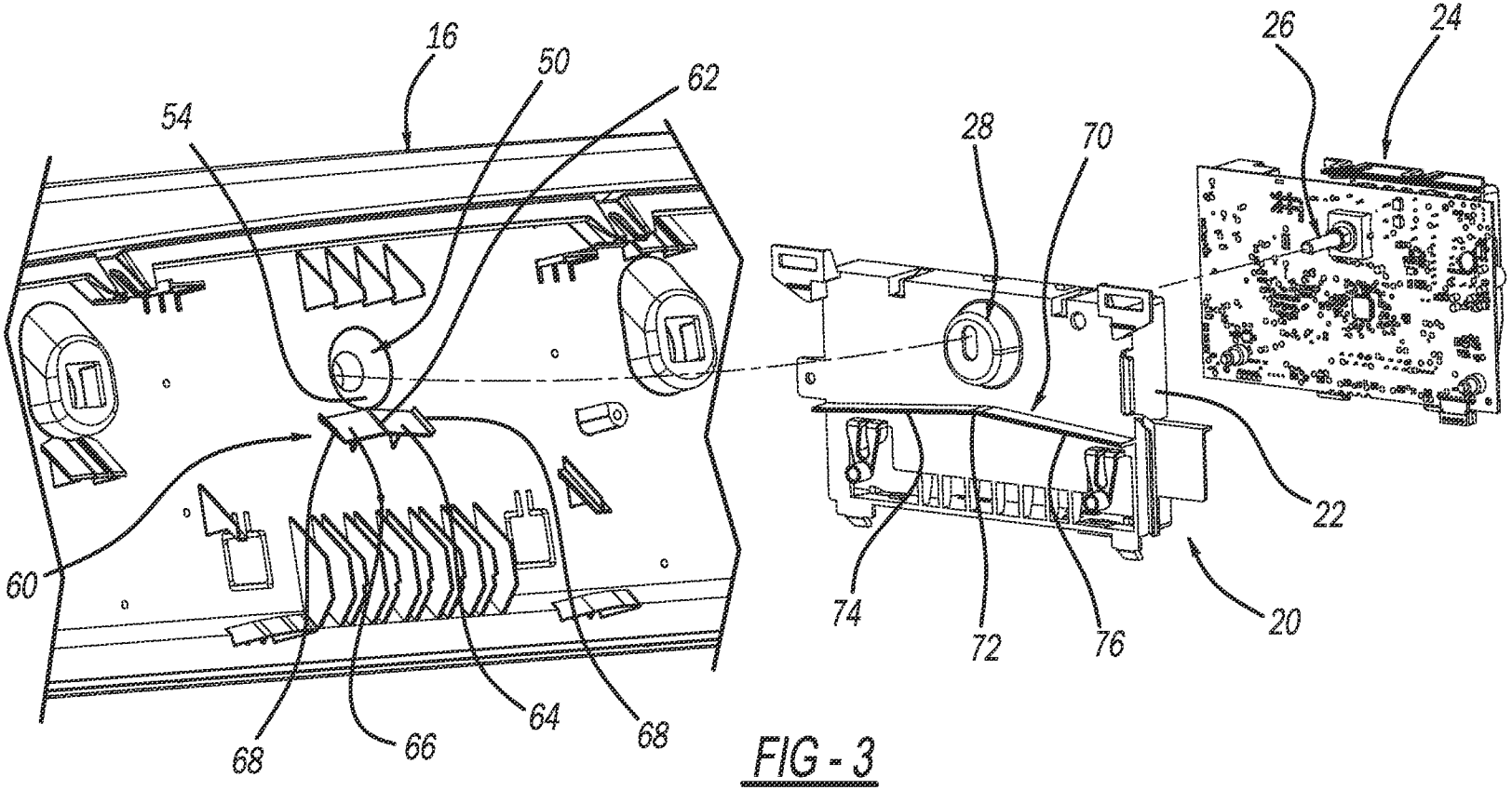
FIG. 3 is an exploded perspective view of the console and the tech frame.

Example embodiments will now be described more fully with reference to the accompanying drawings.

Turning to the figures, a fabric treatment machine, such as a washer or dryer, is illustrated and designated with the reference numeral 10. The fabric treatment machine 10 includes a cabinet 12 with a top panel 14. A console 16 is positioned on the top panel 14. A door 18 enables access inside of the machine 10 to the drum illustrated in phantom. The machine includes elements such as a tub washing circuit or drying circuit so that the fabric treatment machine is functional.

The console 16 hides or covers a tech frame 20. The tech frame 20 includes a housing 22 that houses an activation control unit 24. An activation member 26 extends from the control unit 24 to enable operation of the fabric treatment machine 10. The housing 22 includes a volcano 28 that enables the activation member 26 to project through. The tech frame volcano 28 has a cylindrical wall 30 with a truncated end 32 provided with an aperture 34 to enable the activating member 26 to project through it.

A knob 40 is removably frictionally coupled with the activating member 26. The knob 40 is removable from the activation member 26. The knob includes a cylindrical portion 42 that secures with the activation member 26 via a bore 44.

The console 16 includes a volcano 50. The volcano 50 includes a wall 52. The wall 52 defines a bore 54. The wall 52 has a cylindrical portion 56 mating with a conical portion 58. The bore extends through both the cylindrical 56 and conical 58 portions. The knob cylindrical portion 42 inserts into the bore of the volcano cylindrical portion 56. Thus upon removal of the knob 40, the volcano bore 54 is opened and susceptible to the entry of fluid.

A deflection member 60 is continuous with the wall 52 of the conical portion 58. The deflection member 60 is positioned below the tech frame volcano 28 as well as the activating member 26. The deflection member 60 receives fluid or water that may seep into or through the console volcano 50. Thus, fluid or water that enters into the console volcano 50 will be received by the deflection member 60. This is due to its position and gravity. The deflection member 60 is below the volcano bore 54.

The deflection member 60 extends from the conical wall portion 58 toward the tech frame housing 22. The deflection member 60 includes an apex 62 near its mid portion that divides the deflection member into two portions 64, 66. The apex 62 provides an elongated V shape in cross-section for the deflection member 60. Also, the deflection member 60 includes rails 68 at the end of the legs of the V to direct fluid or water within the deflection member 60 towards the tech frame 20.

The tech frame housing 22 includes a ledge 70. The ledge 70 includes an apex 72 at approximately the mid portion of the deflection member 60. The apex 72 on the ledge 70 divide the ledge 70 into two portions 74, 76. The portions 74, 76 extend away from the apex 72 to provide a drain for fluid or water directed from the deflection member 60. Thus, as the fluid or water enters onto the ledge 70 or drain, it is moved away from the ACU. Accordingly, the fluid or water is moved around the tech housing 20 and thus does not penetrate into the ACU.

Thus, water or fluid entering into the console volcano 50 is moved along the deflection member 60 to the drain or ledge 70. Accordingly, the fluid or water is drained away from the tech frame 20 and is prevented from entering the tech frame volcano 28 at the activation member 26. This provides for drainage of liquid that may enter the console without the need for blockage, via an O ring, of the activation member 26. Additionally, the impact of the knob is taken up by the console cylindrical portion 56 of the volcano 50. This assist in the preservation of the activation member 26 and tech frame 20.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A fabric treatment machine with a console water protection device, comprising:

an activation control unit mounted on a tech frame;

an activation member coupled with the activation control unit;

a console that covers the tech frame;

a console volcano on the console that receives the activation member; and a liquid deflection member on the console positioned adjacent the console volcano to direct fluid entering into the console volcano to a drain on the tech frame that diverts the fluid away from the activation control unit; and a knob that couples with the activation member, wherein the console volcano includes a cylindrical portion that is smaller in diameter than the knob, wherein the console volcano includes a conical portion and wherein the liquid deflection member is continuous with and extends from the conical portion of the console volcano towards the tech frame and is positioned below the activation member.

2. The fabric treatment machine with a console water protection device of claim 1, wherein the liquid deflection member includes a wall defining a channel for directing the fluid to the drain.

3. The fabric treatment machine with a console water protection device of claim 2, wherein the wall includes an apex defining a V shape cross-section with rails at ends of the V shape cross-section for directing the fluid to the drain.

4. The fabric treatment machine with a console water protection device of claim 1, wherein the drain includes a ledge projecting from the tech frame.

5. The fabric treatment machine with a console water protection device of claim 4, wherein the ledge includes an apex adjacent a mid-portion of the liquid deflection member.

6. The fabric treatment machine with a console water protection device of claim 5, wherein the ledge directs the fluid in opposing directions to drain the fluid away from the activation control unit.

7. The fabric treatment machine with a console water protection device of claim 1, further comprising:

a tech frame volcano on the tech frame that has a truncated end with an aperture that receives the activation member.

8. A fabric treatment machine, comprising:

a cabinet housing including treatment components;

a door enabling access to the components within the housing;

a console on the cabinet;

an activation control unit mounted on a tech frame;

an activation member coupled with the activation control unit;

a console volcano on the console that receives the activation member;

a liquid deflection member on the console positioned adjacent the console volcano to direct fluid entering into the console volcano to a drain on the tech frame that diverts the fluid away from the activation control unit, and a knob that couples with the activation member, wherein the console volcano includes a cylindrical portion that is smaller in diameter than the knob, wherein the console volcano includes a conical portion and wherein the liquid deflection member is continuous with and extends from the conical portion of the console volcano towards t tech frame and is positioned below the activation member.

9. The fabric treatment machine of claim 8, wherein the liquid deflection member includes a wall defining a channel for directing the fluid to the drain.

10. The fabric treatment machine of claim 9, wherein the wall includes an apex defining a V shape cross-section with rails at ends of the V shape cross-section for directing the fluid to the drain.

11. The fabric treatment machine of claim 8, wherein the drain includes a ledge projecting from the tech frame.

12. The fabric treatment machine of claim 11, wherein the ledge includes an apex adjacent a mid-portion of the liquid deflection member.

13. The fabric treatment machine of claim 12, wherein the ledge directs the fluid in opposing directions to drain the fluid away from the activation control unit.

14. The fabric treatment machine of claim 8, further comprising:

a tech frame volcano on the tech frame that has a truncated end with an aperture that receives the activation member.

* * * * *